US008110969B2

(12) United States Patent
Tsay et al.

(10) Patent No.: US 8,110,969 B2
(45) Date of Patent: Feb. 7, 2012

(54) GAS-DISCHARGE REFLECTOR LAMP

(76) Inventors: Victor Ivanovich Tsay, Moscow (RU); Vlacheslav Anatolevich Ermoshin, Saransk (RU)

( * ) Notice: Subject to any disclaimer, the term of this patent is extended or adjusted under 35 U.S.C. 154(b) by 0 days.

(21) Appl. No.: 12/276,708

(22) Filed: Nov. 24, 2008

(65) Prior Publication Data

US 2011/0241519 A1 Oct. 6, 2011

(30) Foreign Application Priority Data

May 26, 2006 (WO) ..... PCT/RU2006/000272
May 26, 2008 (WO) ..... PCT/RU2006/000271

(51) Int. Cl.
*H01J 5/16* (2006.01)

(52) U.S. Cl. ..... 313/113; 313/25; 313/567; 313/573; 313/580; 313/634

(58) Field of Classification Search ..... 313/113, 313/25, 567, 573, 580, 634, 635
See application file for complete search history.

(56) References Cited

U.S. PATENT DOCUMENTS 5,041,755 A * 8/1991 Pchelin et al. ..... 313/25
* cited by examiner

*Primary Examiner* — Nimeshkumar Patel
*Assistant Examiner* — Mary Ellen Bowman

(57) ABSTRACT

The invention relates to the electrotechnical industry. Said invention makes it possible to reduce the production cost of, and improve the quality of, gas-discharge reflector lamps. The inventive gas-discharge reflector lamp comprises a light bulb and a burner arranged on current leads into the bulb. At least one half of the bulb's internal surface is coated with a reflective layer in such a way that a plane crossing the parallel edges thereof is parallel to the longitudinal axis of the burner. The bulb is embodied in the form of an ellipsoid. In the area delimited by the bulb neck and dome, the transversal edges of the reflecting layer are located on the cross-sections where the bulb neck and dome gradually transform into the ellipsoidal section, The plane passing through the longitudinal edges of the reflecting layer are located from the bulb axis at a distance H and falls in the range of 0.04-0.11 of the bulb maximum diameter D. The burner is positioned in such a way that, on the cross-section passing through the center of the bulb ellipsoid, the ratio between a distance I from the burner axis to the closest surface of the reflecting layer and a distance L from the burner axis to the edge of the reflecting layer located on the longitudinal section ranges from 0.56 to 0.68. A least one current lead is arranged between the burner and the reflecting layer on the longitudinal plane of symmetry.

1 Claim, 2 Drawing Sheets

GAS-DISCHARGE REFLECTOR LAMP

CROSS-REFERENCE TO RELATED APPLICATION

Figure 1:
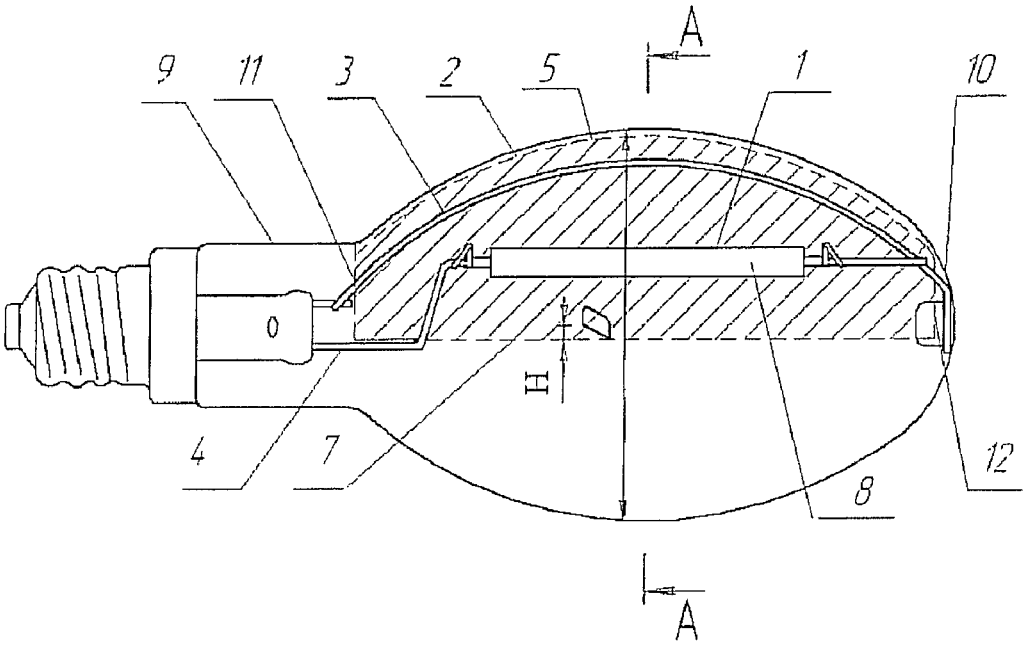

This application claims the benefit of the priority filing date in PCT/RU2006/000272 referenced in WIPO Publication WO/2007/139420. The earliest priority date claimed is May 26, 2006.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The claimed invention pertains to the electric power industry. In particular, it improves the design of gas-discharge reflector lamps for general and special lighting.

A gas-discharge reflector lamp comprising a burner installed in a bulb with a reflective layer on its inside surface is known (USSR certificate of authorship No. 1069032, 01.23.84).

The shortcoming of the technical solution is the loss of lamp light flux as a result of a portion of rays reflecting off the reflective layer of an elongated burner, i.e., incident light rays. Elongated burners are the usual burner in mercury-vapor, metal-halide and sodium-vapor lamps. The problem is the inability to obtain various light intensity curves in longitudinal and lateral planes, which substantially reduces the lamp's performance.

The closest invention to solving this problem in the technical field is a gas-discharge reflector lamp, comprising a burner installed on current leads into the bulb, with at least one-half of the bulb's inside surface covered with a reflective layer so that the plane passing through the layer's longitudinal edges is parallel to the burner longitudinal axis (USSR certificate of authorship No. 1636896 Al, 03.23.91).

This technical solution, used as the prototype, makes it possible to obtain lamps with high light output and different light intensity curves in longitudinal and lateral planes, which is important when using the lamps for illumination of roads, greenhouses, etc.

The prototype's shortcomings results in the high cost of lamps due to the complexity of manufacturing axially asymmetric bulbs, or bulbs with uneven wall thickness, because it is impossible to rotate forms for injection when making the bulbs, and because of the high probability of tension in the glass during the lamp's operation.

The invention's objective is to reduce the cost of, and improve the quality of, gas-discharge reflector lamps. The stated objective is achieved when, in the case of a gas-discharge reflector lamp comprising a burner installed on current leads into the bulb, with at least one-half of the bulb's inside surface covered with a reflective layer so that the plane passing through the layer longitudinal edges is parallel to the burner longitudinal axis, the bulb has an ellipsoidal shape. In the area bound by the bulb neck and dome, the reflective layer's lateral edges are located in cross-sections where the bulb neck and dome join the ellipsoidal portion. The plane passing through the reflective layer's longitudinal edges is shifted from the bulb axis by a distance H and is located within 0.04-0.11 of maximum inside diameter D of the bulb. The burner is located in the longitudinal symmetry plane. In the cross-section passing through the bulb ellipsoid center, the ratio of the distance from the burner axis to the nearest surface of reflective layer 1 to the distance from the burner axis to the reflective layer edge L located in the longitudinal section is between 0.56 and 0.68. At least one current lead is located between the burner and the reflective layer in the longitudinal symmetry axis.

SUMMARY

The present invention is designed to reduce the production cost of, and improve the quality of, gas-discharge reflector lamps.

The gas-discharge reflector lamp comprises a burner installed on current leads into the bulb, at least half of the bulb's inner surface is covered with a reflective layer so that the plane passing through the layer's longitudinal edges is parallel to the burner's longitudinal axis.

The bulb has an ellipsoidal shape.

The reflective layer's lateral edges in the area bound by the bulb neck and dome are located in cross-sections in areas where the bulb neck and dome join the ellipsoidal section. The plane passing through the reflective layer's longitudinal edges are shifted from the bulb axis by a distance that is within 0.04-0.11 of the bulb's maximum inside diameter.

The burner placed so that, in the cross-section through the bulb's ellipsoid center, the ratio of the distance from the burner axis to the closest surface of the reflective layer to the distance from the burner's axis to the reflective layer's edge located in the longitudinal section is between 0.56 and 0.68.

At least one current lead is placed between the burner and the reflective layer in the longitudinal symmetry plane.

FIGURES

FIG. 1 shows the general view of the gas-discharge reflector lamp in the longitudinal symmetry plane. Burner 1 is installed on current leads 3, 4 into ellipsoidal bulb 2 bound by the neck 9 and dome 10. Bulb 2 has a reflective layer indicated by hatching 5, with a longitudinal edge 7. The reflective layer's lateral edges are located in cross-sections where the bulb's ellipsoidal portion joins the bulb neck 11, and the bulb dome joins the ellipsoidal portion 12, and are indicated with a dotted line.

Figure 2:
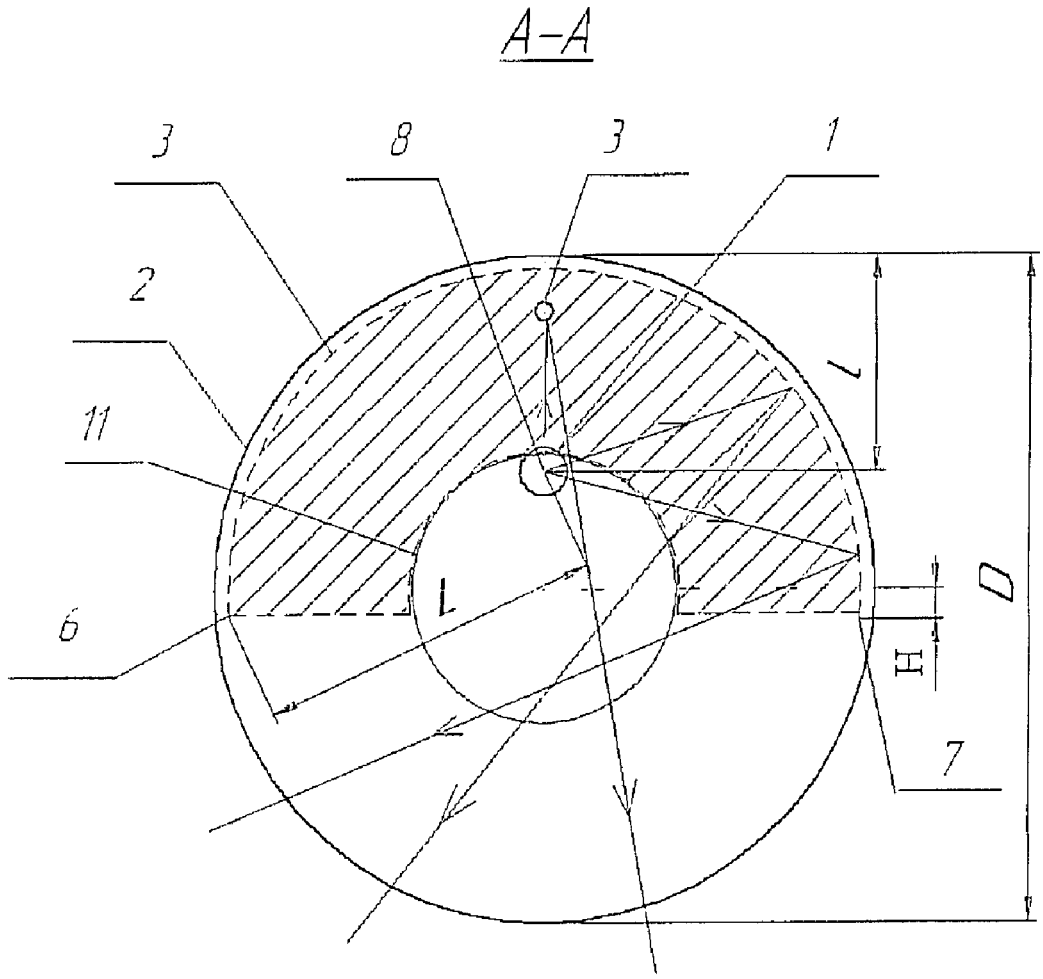

FIG. 2 shows the lamp cross-section A-A passing through the bulb ellipsoid center. The Bulb 2 has a reflective layer 3. The plane passes through the reflective layer's longitudinal edges 6 and 7 is shifted from the bulb axis by a distance H and is between 0.04 and 0.11 of bulb maximum diameter D. Burner 1 is placed so that the ratio of the distance from burner axis 8 to the nearest surface of reflective layer 1 to the distance from the burner axis to the edge of reflective layer L located in the longitudinal section is between 0.56 and 0.68. The arrows indicate incident and reflected rays.

DESCRIPTION

During the lamp's operation, when the reflective layer's lateral edge is placed closer to the neck from the area where the bulb neck joins the ellipsoidal portion, an elevated base temperature is observed that adversely affects the putty and solder because, after reflection off the reflective layer in the neck, part of the emission hits the base.

When the reflective layer's lateral edges are placed closer to the burner from the area where the bulb neck and bulb dome joins the ellipsoidal portion, light flux reduction is observed because part of the net emission goes to the upper semi-sphere and reduces the lamp light flux.

When the reflective layer's lateral edge is placed closer to the dome from the area where the bulb dome joins the ellipsoidal portion, a forced contact of current lead 11 with the reflective layer is observed, and an electric field is generated around the operating burner that adversely affects the life of the lamp. On the other hand, placing the current lead insulated area near the reflector makes a lamp much more expensive.

Placing the plane passing through the reflective layer's longitudinal edges closer than 0.04 of maximum bulb diameter D from the bulb axis, limits the ability to make lamps with different light intensity curves and achieve the required angle of shade.

Placing the plane passing through the reflective layer's longitudinal edges farther than 0.011 of maximum bulb diameter D increases the share of emissions, after multiple reflections, and reduces the lamp light flux.

When the burner is placed so that the ratio of the distance from the burner axis to the closest surface of the reflective layer 1 to the distance from the burner axis to the reflective layer's edge L located on the longitudinal section is less than 0.56, the share of emissions reflected off the reflective layer is high, leading to the burner overheating.

When the burner is placed so that, in the cross-section through the bulb ellipsoid center, the ratio of the distance from the burner axis to the closest surface of reflective layer 1 to the distance from the burner axis to the reflective layer edge L located on the longitudinal section is less than 0.56, the reflective layer has a high negative effect on the burner.

When at least one wire current lead is placed between the burner and the mirror layer in the longitudinal symmetry plane, the number of reflected rays incident on the burner from the reflective layer decreases.

The lamps are assembled as follows: A reflective layer is applied to the bulb, using screens to cover the bulb areas bounding the reflective layer. Current leads are formed, and the burner is attached. The stem with the current leads is welded into the bulb while placing the burner in a strictly predefined spot relative to the reflective layer. Then, the base is attached to the lamp.

The lamp works as follows: Light rays come from the burner center in the direction of the reflective layer located inside the bulb. Normal lines to the reflector surface at the ray's incidence point are mainly directed past the burner axis; because of this, the majority of reflected rays pass through the burner and are not attenuated by it.

Light rays coming from the burner in the direction of the bulb surface without the reflective layer come out of the lamp without reflection.

Where the normal line to the reflector surface at the ray's incidence point is directed on the burner, a ray is incident on the burner. At least one current lead is placed between the burner and reflective layer in the longitudinal symmetry plane, and because of this, the minimum amount of reflected rays are incident on the burner.

The proposed lamp with a burner from a lamp (ДНаТ [DNaT]) with 250 power is made with a 120 mm diameter ellipsoidal bulb. The burner axis is shifted 19 mm from the lamp axis, and the reflective layer's lateral edges are shifted 8 mm from the bulb axis. The lamp light output is 104 lm/W. The lamp light intensity curves in the longitudinal and lateral directions are similar to series-produced irradiators (ОТ 400-ПОП-ДНаТ [OT 400-POP-DNaT]) with reflective film surfaces (УЩЗТ-15-400-ПОПИ(С) [UShChZT-15-400-POP]).

The proposed lamp makes it possible to reduce installation capacity and power consumption by 33% to 45% and increase plant productivity by more than 15%.

The use of the claimed invention in the manufacture of sodium-vapor reflector lamps will make it possible to reduce lamp cost and maintain high light output.

What is claimed is:

1. A gas-discharge reflector lamp, comprising a burner installed on current leads into the bulb, at least half of the bulb's inner surface is covered with a reflective layer so that the plane passing through the layer's longitudinal edges is parallel to the burner's longitudinal axis;

the bulb having an ellipsoidal shape;

the reflective layer's lateral edges in the area bound by the bulb neck and dome being located in cross-sections in areas where the bulb neck and dome join the ellipsoidal section;

the plane passing through the reflective layer's longitudinal edges being shifted from the bulb axis by a distance H and is within 0.04-0.11 of the bulb's maximum inside diameter D;

the burner placed so that, in the cross-section through the bulb's ellipsoid center, the ratio of the distance from the burner axis to the closest surface of the reflective layer to the distance from the burner's axis to the reflective layer's edge L located in the longitudinal section is between 0.56 and 0.68; and at least one current lead is placed between the burner and the reflective layer in the longitudinal symmetry plane.

* * * * *